US005227133A

United States Patent [19]

Bucher et al.

[11] Patent Number: 5,227,133

[45] Date of Patent: Jul. 13, 1993

[54] METHOD AND COMPOSITION FOR INHIBITING GENERAL AND PITTING CORROSION IN COOLING TOWER WATER

[75] Inventors: Bradley A. Bucher; Jesse H. Jefferies, both of Houston, Tex.

[73] Assignee: Gulf Coast Performance Chemical, Inc., Houston, Tex.

[21] Appl. No.: 982,013

[22] Filed: Nov. 24, 1992

Related U.S. Application Data

[63] Continuation of Ser. No. 685,087, Apr. 11, 1991, abandoned.

[51] Int. Cl.[5] ..... C23F 11/18

[52] U.S. Cl. ..... 422/18; 210/697; 210/699; 210/700; 210/701; 252/389.2; 252/389.54; 252/389.67; 422/14; 422/15

[58] Field of Search ..... 422/14, 15, 18; 210/697, 699, 700, 701; 252/389.2, 389.54, 389.62

[56] References Cited

U.S. PATENT DOCUMENTS

| | | | |
|---|---|---|---|
| 4,176,059 | 11/1979 | Suzuki | 422/16 |
| 4,440,721 | 4/1984 | Wilson et al. | 422/15 |
| 4,711,725 | 12/1987 | Amick et al. | 252/180 |
| 4,717,495 | 1/1988 | Hercamp et al. | 252/389.2 |
| 4,728,452 | 3/1988 | Hansen | 422/16 |
| 4,873,011 | 10/1989 | Jung et al. | 252/389.54 |
| 4,963,290 | 10/1990 | Bressan et al. | 252/389.54 |

*Primary Examiner*—Robert J. Warden
*Assistant Examiner*—Timothy M. McMahon
*Attorney, Agent, or Firm*—Browning, Bushman, Anderson & Brookhart

[57] ABSTRACT

A method of inhibiting the pitting corrosion rate of carbon steel in a cooling tower system comprising adding to a cooling tower water an effective amount of a corrosion inhibiting composition containing from about 1 to about 10 ppm of a water soluble molybdate, calculated as molybdate and from about 5 to about 25 ppm of a stabilized phosphate, calculated as phosphate, the corrosion inhibiting composition being substantially free of active zinc, and circulating the water in the system.

9 Claims, 3 Drawing Sheets

METHOD AND COMPOSITION FOR INHIBITING GENERAL AND PITTING CORROSION IN COOLING TOWER WATER

This is a continuation of co-pending U.S. application Ser. No. 07/685,087 filed on Apr. 11, 1991 now abandoned.

BACKGROUND OF THE INVENTION

1. Field of the Invention

The present invention relates to a method of inhibiting corrosion in cooling tower systems and, more specifically, for lowering the pitting rate associated with tuberculation of carbon steel and other corrosion-prone materials to less than the general corrosion rate.

Cooling towers are widely used in the industry to cool water used in heat exchangers, refrigeration units, etc. Commonly, the cooling tower systems employed in such environments are of the recirculating type; that is, the water used for cooling purposes is recycled to the cooling tower for chilling via evaporation. It is common for the cooling tower water to become corrosive from time to time, regardless of the level of sophistication of chemical addition and treatment. During these occurrences, tuberculation can form on the surface of the metal which provides sites for pitting corrosion. The subsequent pitting beneath the tuberculation is the most serious form of corrosion and the primary cause of corrosion-induced equipment failure in cooling systems.

Specifically then, there are two types of corrosion which must be controlled. General, or uniform, corrosion and pitting, or localized, corrosion. General corrosion rate is the measure of the thickness of metal lost. It is measured in thousands of an inch of metal loss per year, referred to as mils per year (mpy). Pitting corrosion is also expressed as mils per year, but refers to depth at a specific site.

Typically, an untreated water system my have a general (uniform) metal loss of 0.060 inches per year (60 mpy). By the addition of corrosion inhibitors, the general corrosion rate can be reduced. In a properly treated cooling system the general corrosion rate will normally be measured at less than 5.0 mpy. The pitting rate is considered to be properly controlled if it is three to five times the general corrosion rate. Both the general and pitting rates can be measured either via metal coupons, or with electrical corrosion measuring instruments.

2. Description of the Background

Historically, a wide assortment of anti-corrosion compositions have been use for corrosion inhibition. For example, heavy metals, such as water-soluble chromium and zinc compounds have been used to virtually eliminate general corrosion and to a certain extent control pitting corrosion. Pitting corrosion, however, is still a serious problem. Since environmental considerations have progressively eliminated the use of toxic, heavy metals, such as chromate and zinc, less effective or more expensive corrosion inhibitors have come into extensive use. For example, it is known that water-soluble molybdates are effective in controlling corrosion and do not present environmental problems. However, molybdates are relatively expensive to use.

As disclosed in U.S. Pat. No. 4,867,944, incorporated herein by reference, effective corrosion inhibition in cooling tower systems can be accomplished by the use of a composition which includes a water-soluble zinc compound, a water-soluble molybdate and an orthophosphate. Similar corrosion inhibitors are also disclosed, for example, in U.S. Pat. Nos. 4,217,216; 4,176,059; 4,017,315; DE No. 2850925 and Japan Kokai JP No. 52/38438 (77/38437). Additionally, an article entitled "Molybdate As A Pipeline Corrosion Inhibitor For Co-Water Slurry Systems", Phys. Metall. Res. Lab. 1986, discloses a composition comprised of molybdate, zinc sulfate and potassium phosphate as an erosion-corrosion inhibitor for steel used in cold water slurries.

Although the use of molybdates, alone and in combination with other corrosion inhibitors such as phosphates, provide more effective general corrosion inhibitors in the sense that certain environmental problems can be alleviated if the molybdates are used without toxic, heavy metals, there is still no known method of effecting control of pitting corrosion to the point where it can be virtually eliminated or at least reduced to a point less than or equal to the general corrosion rate.

SUMMARY OF THE INVENTION

It is therefore an object of the present invention to provide an improved method and composition for reducing the pitting corrosion in cooling tower systems.

Another object of the present invention is to provide a method and composition for reducing the pitting corrosion in cooling tower systems which eliminates the use of toxic, heavy metals.

Still a further object of the present invention is to provide a method and composition for reducing the pitting corrosion in cooling tower systems to a point less than, or equal to, the general corrosion rate.

The above and other objects of the present invention will become apparent from the description given herein, the accompanying drawings, and the appended claims.

In one aspect of the present invention, there is provided a method of inhibiting the pitting corrosion rate of carbon steel in a cooling tower system comprising adding to the cooling tower water an effective amount of a corrosion inhibiting composition comprising from about 1 to about 10 part per million (ppm) of a water-soluble molybdate, calculated as molybdate, and from about 5 to about 24 ppm of a stabilized orthophosphate, calculated as phosphate, said corrosion inhibiting composition being substantially free of any added active zinc, e.g. water-soluble zinc compounds, and circulating said water in said system.

In another aspect of the present invention, there is provided a composition for use in inhibiting pitting corrosion of carbon steel in a cooling tower system, the composition comprising from about 1 to about 10 ppm of a water-soluble molybdate, calculated as molybdate, and from about 5 to about 25 ppm of a stabilized orthophosphate, calculated as phosphate, the composition being substantially free of any active zinc.

DESCRIPTION OF THE PREFERRED EMBODIMENT

Figure 1:
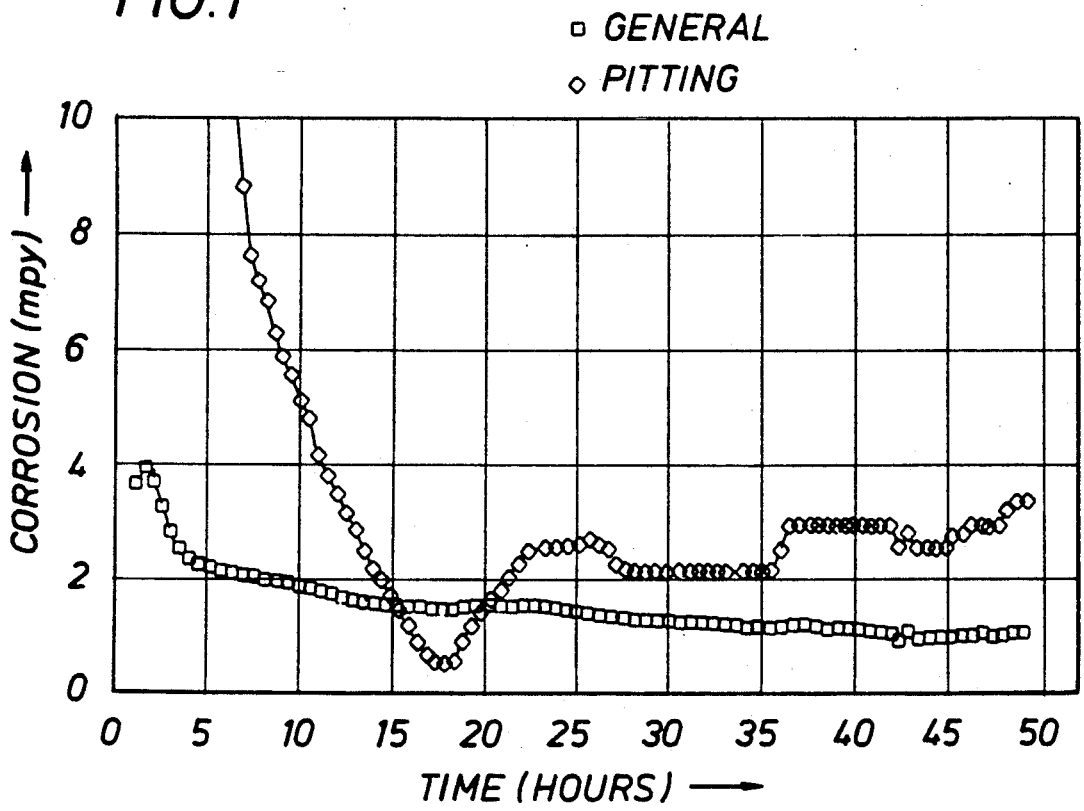
FIG. 1 is a graph showing a comparison of general and pitting corrosion rates using stabilized phosphate without any molybdate.

The present invention is based upon the unexpected finding that the use of a corrosion inhibiting composition containing a water-soluble molybdate and a stabilized orthophosphate results in a pitting corrosion rate which is less than, or equal to, the general corrosion rate. Thus, the composition of the present invention can comprise, consist of, or consist essentially of the molybdate and the stabilized orthophosphate. In particular, it has been found that if there is no zinc present in a form and a level which would normally allow it to act as a corrosion inhibitor (hereafter referred to as "active zinc"), the pitting corrosion rate is less than the general corrosion rate. Such active zinc compounds are usually inorganic, water-soluble compounds such as zinc halides. Thus, there is provided a corrosion inhibiting composition which is environmentally safe since it eliminates toxic, heavy metals such as zinc.

The two main components used in the method and composition of the present invention are a water-soluble molybdate and a stabilized phosphate (orthophosphate). The water-soluble molybdate can be virtually any molybdate, usually an inorganic molybdate, which has sufficient water solubility for the particular cooling tower water system. Alkali metal molybdates are preferred, sodium molybdate being especially preferred because of its relative high solubility. The molybdate compound will be present in the compositions in an amount of from about 1 to about 10 ppm, calculated as molybdate ($MoO_4-$) as the active component, amounts of molybdate of from about 3 to about 6 ppm being especially desirable.

The second major component used in the compositions and method of the present invention is a "stabilized" phosphate. The word "stabilized", as used herein, refers to a condition under which orthophosphate in the water being treated will remain in solution despite a level of calcium or similar metal ions and system pH which would normally result in precipitation of generally insoluble metal (calcium) phosphate. In this regard, it is known that phosphate has a limited solubility in water when calcium and other alkaline earth metals are present, phosphate solubility following the equation:

$$26 \log_{10}(pH)+\log_{10}(oPO_4)+1.5 \log_{10}(CaCO_3)=25.5$$

It is also known that corrosion protection improves as phosphate levels are raised. Indeed, general corrosion rates are reduced most effectively when the phosphate level, calcium level and the system pH are such that the solubility of calcium phosphate is exceeded in accordance with the equation shown above. In order to achieve the benefits of using high phosphate levels in corrosion protection but prevent unwanted precipitation of calcium or other similar metal phosphates, it is known to employ what are known as "stabilized" phosphates. Stabilized phosphates, as is known to those skilled in the art, are achieved by incorporating in or adding to the orthophosphate-containing cooling water one or more polymeric materials which by various proposed theories prevent the precipitation of calcium or other metal phosphates. Stabilization of phosphates and polymers used therefore are disclosed in U.S. Pat. No. 4,711,725, and other patents mentioned therein, all of which are hereby incorporated by reference for all purposes. In general, there are a myriad of dispersants or materials, which are generally polymeric in nature, e.g. homopolymers, copolymers, terpolymers, which will prevent precipitation or crystallization of calcium or similar metal phosphates.

Non-limiting examples of materials (phosphate stabilizers) used to form stabilized phosphates include polymers derived from (meth)acrylic acids and salts as well as mixtures of such polymers with other compounds and polymers, such as phosphonic acids, copolymers of (meth)acrylic acids and vinyl esters, such as hydroxyethyl methyacrylate and hydroxy proplacrylate, and copolymers of (meth)acrylic acids and salts with acrylamidl alkyl or aryl sulfonates or unsubstituted acrylamides. Additionally, polymers, e.g., homopolymers, copolymers and terpolymers, formed from acrylic acid, 2-acrylamido-2-methyl propane sulfonic acid (AMPS) and unsubstituted acrylamides have also been proposed for use. Still other materials which are disclosed in the aforementioned U.S. Pat. No. 4,711,725 can be employed as phosphate stabilizers. It is to be understood that the phosphate stabilizers which can be employed include any compound, polymer, whether synthetic or natural, or mixtures thereof, which can perform the function of preventing precipitation and/or crystallization of insoluble metal phosphate under conditions, e.g. pH, which would result in precipitation of such phosphates if the phosphate stabilizers were not present. In general, the phosphate stabilizers will be present in an amount ranging from about 1 to about 30 ppm.

The stabilized orthophosphate will be present in the method and composition of the present invention in an amount of from about 5 to about 20 ppm, calculated as phosphate ($PO_4$). The orthophosphate can be any water-soluble orthophosphate and can include, without limitation, compounds such as monosodium phosphate, disodium phosphate, trisodium phosphate, phosphoric acid, etc. It will be recognized that the orthophosphates, generally the most hydrated form of phosphate, are to be distinguished from polyphosphates which can also be used in the composition and which exhibit some lower degree of hydration together with being comprised of multiple $PO_4$ groups.

Although an effective corrosion inhibitor which will reduce pitting corrosion to a level equal to or below that of general corrosion can be obtained using only the molybdate compound and the stabilized phosphate as described above and provided there is no added active zinc as described hereafter, it is to be understood that other, conventional agents or additives normally employed in corrosion inhibiting compositions can be employed. For example, polyphosphates can be employed with advantage, the polyphosphates, when employed, normally being present in amounts ranging from about 1 to about 30 ppm, calculated as phosphate. Thus, nonlimiting examples of useful water-soluble polyphosphates include tetrapotassium pyrophosphate, sodium hexametaphosphate, sodium tripolyphosphate, tetrasodium pyrophosphate, etc. It will be appreciated that when placed in a water solution, polyphosphates can, to some extent, convert to orthophosphates. Accordingly, it is within the scope of the present invention to form the stabilized phosphate by adding only a polyphosphate compound in an amount which will provide the required amount of orthophosphate as set out above.

The corrosion inhibiting composition and method of the present invention can also contain, with advantage, dispersants, such as polycarboxylic acids, e.g. polymaleic anhydride, various other homopolymers and copolymers, organic phosphonates, etc., which serve as iron sequestrants. When employed, such dispersants or sequestrants will generally be present in amounts generally ranging from about 1 to about 20 ppm in the cooling tower water.

When copper components are present in the cooling tower system, it is also desirable to incorporate copper and copper alloy corrosion inhibitors such as mercaptobenzotriazole (MBT), benzotriazole (BZT), tolyltriazole (TTA), etc. When employed, such copper corrosion inhibitors will generally be present in an amount of from about 1 to about 20 ppm of the cooling tower water.

If desired, the compositions can also contain microbiocides, anti-foulants, and other such additives.

In carrying out the method of the present invention, the corrosion inhibiting composition will be introduced into the cooling tower water in an effective amount, i.e., an amount which takes into the account parameters such as the degree of contamination of the cooling tower water, the pH, etc., which can be determined by well known methods. Generally, an amount of from about 20 to about 100 ppm of the inhibitor composition, calculated as the total of the active components, is employed. It will be recognized, however, that smaller or greater amounts can be employed depending on the condition of the cooling tower water.

In carrying out the method of the present invention, the components of the composition can be added in virtually any manner. It is convenient to add the water-soluble molybdate in conjunction with the stabilized phosphate and any other additional corrosion inhibiting additives to the cooling water as a combined mixture by conventional, well known methods. However, the individual components can be added separately if desired.

As noted above, the present invention is buttressed on the finding that if molybdate and stabilized phosphate are used together in the substantial absence of water-soluble zinc compounds or other sources of active zinc, the pitting rate can be maintained at a level equal to or below the general corrosion rate. For some reason, not totally understood, the presence of active zinc, which is generally regarded as a highly effective general corrosion inhibitor interferes with the combined action of the molybdate and the stabilized phosphate. The term "substantially free of active zinc", as used herein, refers to a level of zinc below which the zinc does not act to any significant extent as a corrosion inhibitor. Generally speaking, a level of zinc of 0.5 ppm or less, calculated as zinc, would be considered substantially free of active zinc. Amounts of about 0.5 ppm or greater of active zinc results in increased pitting corrosion, i.e. a pitting corrosion rate equal to or greater than the general corrosion rate. It will also be understood that substantial levels of zinc in the corrosion inhibitor can be tolerated if the zinc is in some form, e.g. chelated, which does not normally allow it to act as a corrosion inhibitor.

The present invention has proven to be particularly effective in preventing, or inhibiting, pitting corrosion associated with tuberculation. As carbon steel is the metal that is most commonly used in cooling system piping and in heat exchanger construction, pitting of carbon steel is of major interest to the industry. The present invention can be used on various types of cooling tower systems, such as forced draft towers, induced draft towers, and hyperbolic towers. Tower flow may be counterflow or crossflow. The method and composition find equal application to atmospheric cooling towers and natural draft towers, but find particular application in open, recirculating cooling tower systems.

To more fully illustrate the present invention, the following non-limiting examples are presented. Amounts are calculated on a per weight basis of the active agent, e.g. $PO_4$, $MoO_4$, etc.

EXAMPLE 1

Clarified Brazos river water was concentrated to five cycles and the mAlkalinity adjusted to 100 ppm. To a sample of this water was added a stabilized phosphate corrosion inhibitor having the following composition:

TABLE 1

| COMPONENT | ACTIVE PPM |
|---|---|
| Monosodium phosphate | 20 |
| Tetrapotassium pyrophosphate (TKPP) | 7 |
| Hydroxyethylidenediphosphonate (HEDP) | 3 |
| Tolytriazole (TTA) | 4 |
| Polymaleic anhydride (PMA) | 5 |
| AMPS (Copolymer) | 10 |

The data on general and pitting corrosion rates was acquired using a Rohrback Cosasco Model 9030 Corrator. Both general and pitting corrosion rates were measured and computer logged every 15 seconds. Every thirty minutes the previous 120 sample points were averaged and added to the database for graphic presentation. Thus, every twenty-four hours it was possible to plot 48 data points representing the averages of 5,760 discreet readings. The resulting general and pitting corrosion rates are shown in FIG. 1. As can be seen from FIG. 1, after an initial brief passivation period. The general corrosion rate leveled out at 1.0 mpy and the pitting rate at 2.8 mpy. These results closely mirror data which workers in the field have generally observed using stabilized phosphate alone.

EXAMPLE 2

To a second sample of the Brazos River water used in Example 1 was added the corrosion inhibiting composition shown in Table 1 with the exception that the composition contained sufficient sodium molybdate to provide 6.0 ppm active molybdate ($MoO_4$). The data was obtained in the manner described in Example 1, the results being shown graphically in FIG. 2.

Figure 2:
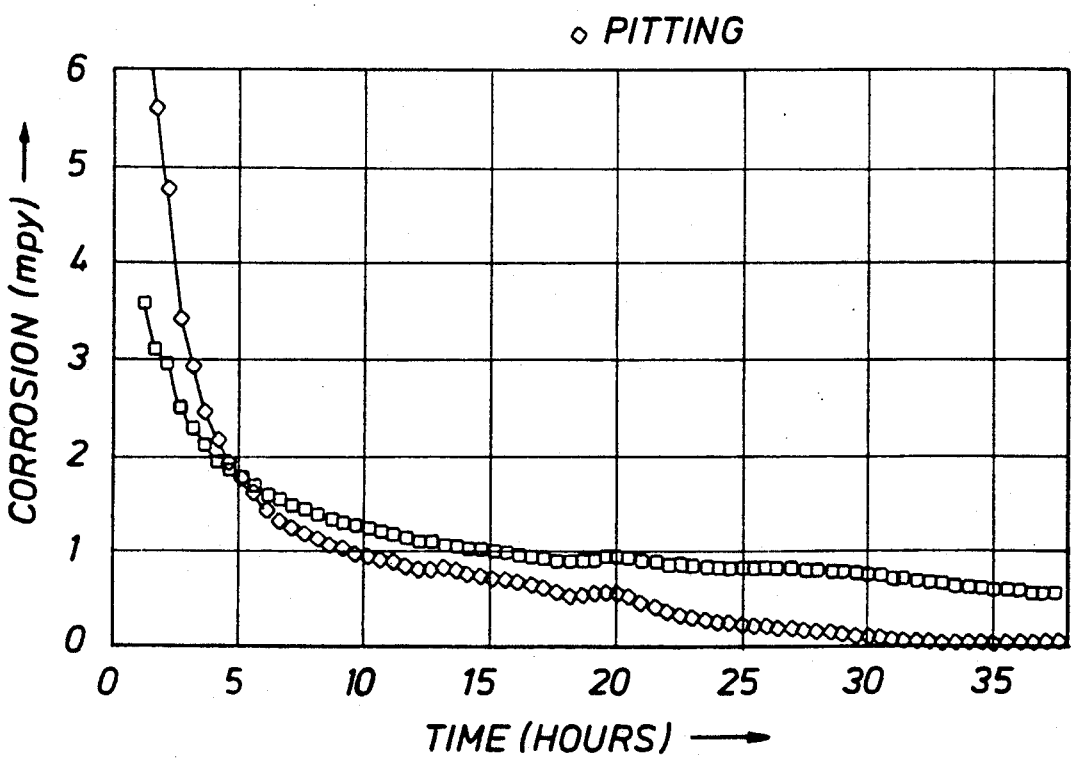
FIG. 2 is a graph similar to FIG. 1 showing a comparison of general and pitting corrosion rates using stabilized phosphate and molybdate.

As can be seen from reviewing FIG. 2, the addition of molybdate to the stabilized phosphate improves the general corrosion rate to 0.6 mpy. However, and dramatically, the pitting corrosion rate lowered to only 0.1 mpy, a rate heretofore thought unobtainable vis-a-vis the general corrosion rate.

EXAMPLE 3

Figure 3:
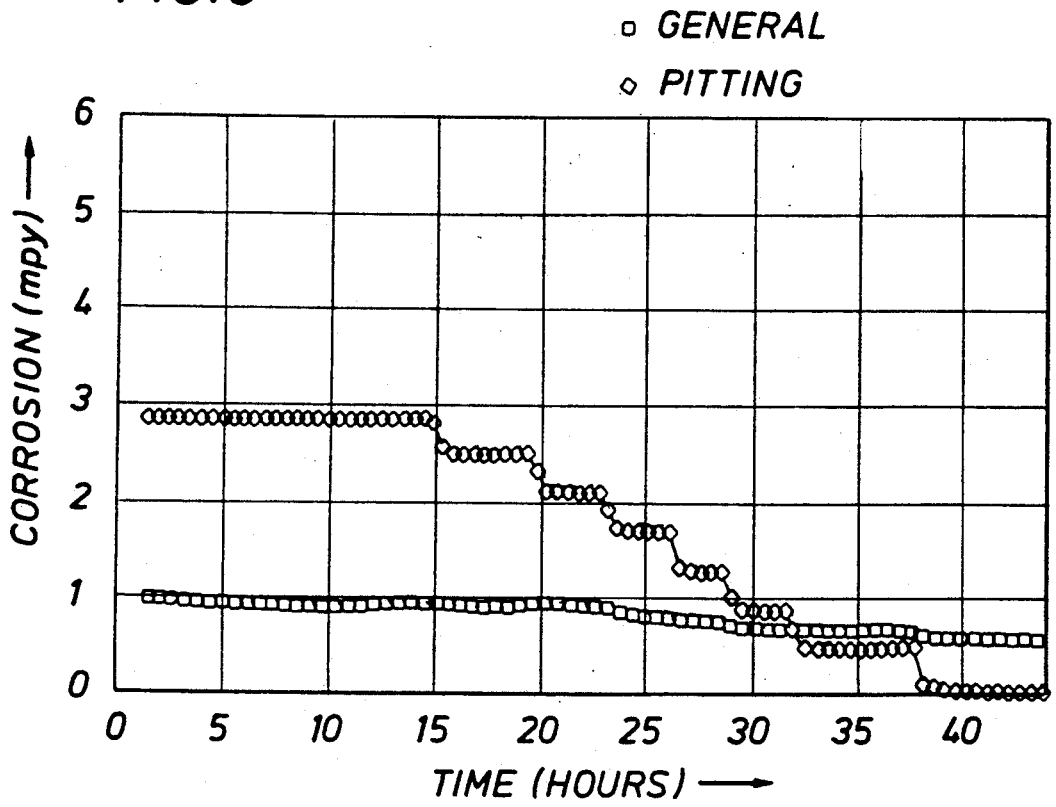
FIG. 3 is a graph showing a comparison of general and pitting corrosion rates using stabilized phosphate and molybdate in which the molybdate has been added incrementally over time.

To a third sample of the Brazos River water used in Examples 1 and 2 was added the corrosion inhibiting composition shown in Table 2. Subsequent to the initial addition of the corrosion inhibiting composition, sodium molybdate was incrementally added to provide an active level of molybdate of 0.5 ppm. The results, measured as per the method of Example 1, are shown graphically in FIG. 3 which demonstrates that as the molybdate level increases, pitting corrosion rates dramatically decrease and eventually fall below general corrosion rates. The results of FIG. 3 also demonstrate that at a level of about 3.5 ppm of molybdate, maximum inhibition of pitting corrosion is obtained.

TABLE 2

| COMPONENT | ACTIVE PPM |
|---|---|
| Monosodium phosphate | 13 |
| Tetrapotassium pyrophosphate (TKPP) | 4.5 |
| Hydroxyethylidenediphosphonate (HEDP) | 2.5 |
| Tolytriazole (TTA) | 2 |
| Polymaleic anhydride (PMA) | 3 |
| AMPS (Copolymer) | 6.5 |

EXAMPLE 4

The composition and method of the present invention was tested in an open, recirculating cooling tower system used in a refinery. The corrosion inhibiting composition was as follows:

TABLE 3

| COMPONENT | ACTIVE PPM |
|---|---|
| Monosodium phosphate | 10 |
| Sodium molybdate | 4 |
| TKPP | 3 |
| HEDP | 1.6 |
| TTA | 1.5 |
| AMPS (Terpolymer) | 2 |
| AMPS (Copolymer) | 5.2 |
| PMA | 1.6 |

Figure 4:
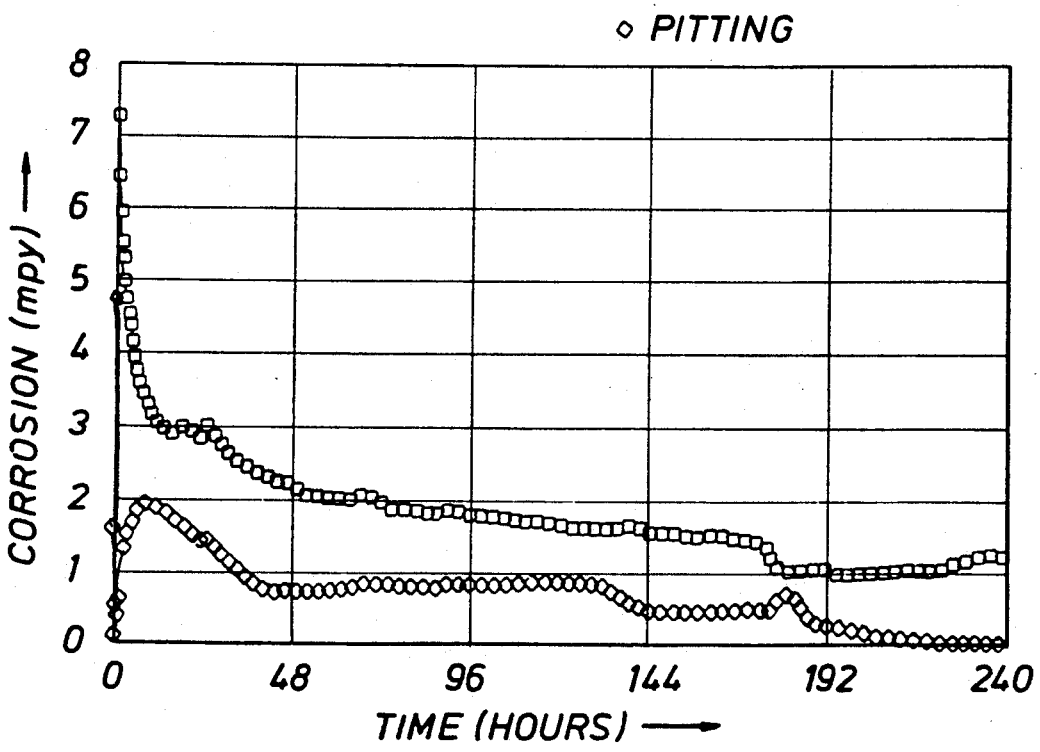
FIG. 4 is a graph showing a comparison of general and pitting corrosion rates for a refinery cooling system using stabilized phosphate and molybdate.

Pitting and general corrosion measurements were made generally according to the procedure of Example 1. The results are shown graphically in FIG. 4 which plots corrosion rates over a 240 hour time period. As can be seen from FIG. 4, the same characteristic passivation curve was followed by the general corrosion rate leveling at 1.1 mpy and the pitting corrosion rate at 0.2 mpy. Data collection over a six-month period had consistently shown 0.5 mpy general and 0.1 mpy pitting corrosion rates demonstrating that the method and composition of the present invention achieved the remarkable result of maintaining the pitting corrosion rate at a level below the general corrosion rate.

EXAMPLE 5

The procedure of Example 4 was repeated on an open, recirculating cooling tower system in a petrochemical facility. The corrosion inhibiting composition employed was as shown in Table 4.

TABLE 4

| COMPONENT | ACTIVE PPM |
|---|---|
| Sodium phosphate | 8 |
| Sodium molybdate | 4 |
| Zinc chloride | 2 |
| TKPP | 2.5 |
| HEDP | 2 |
| TTA | 1.5 |
| AMPS (Terpolymer) | 1.5 |
| AMPS (Copolymer) | 2.4 |
| PMA | 3.1 |

Figure 5:
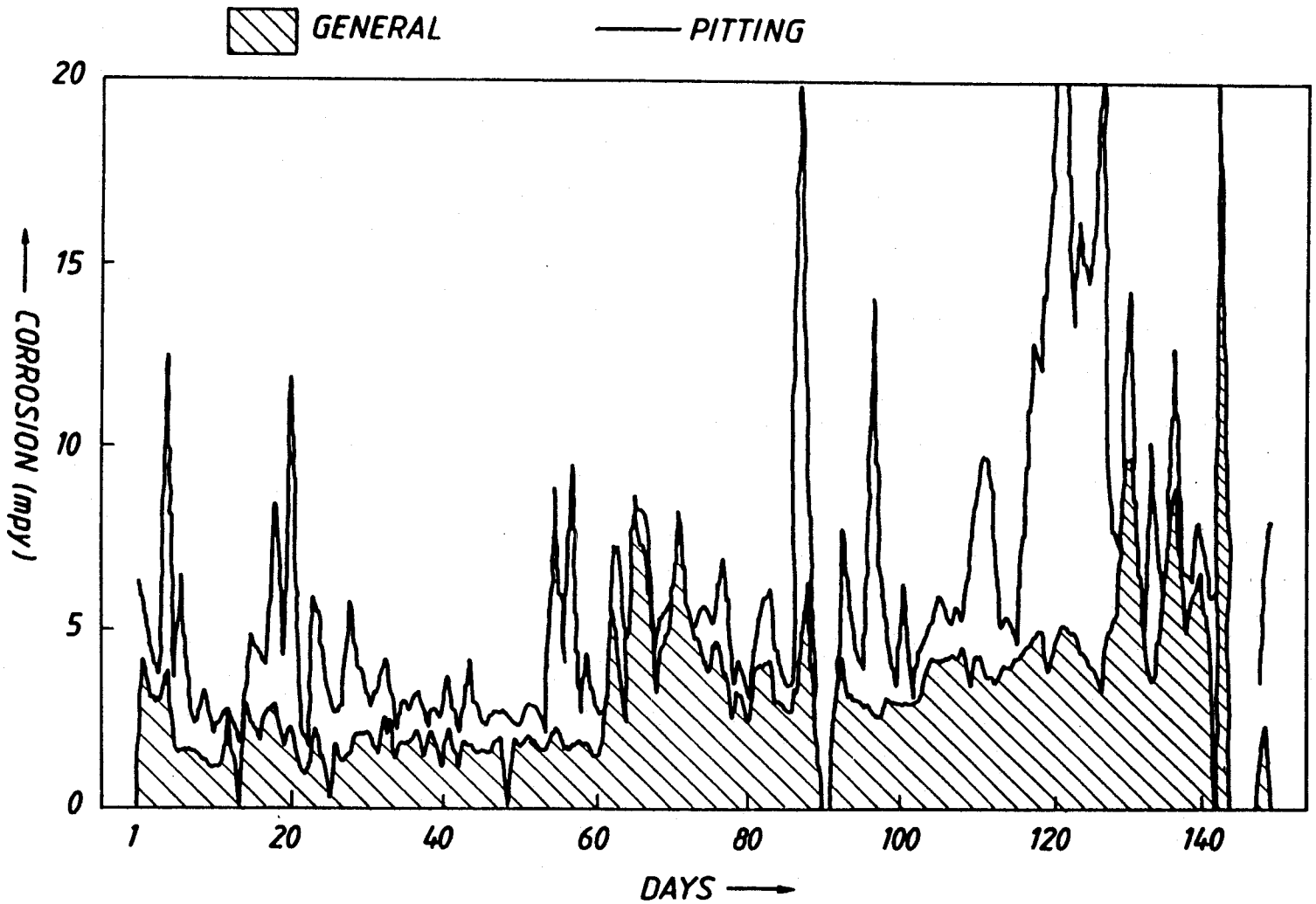
FIG. 5 is a graph showing a comparison of general and pitting corrosion rates in a petrochemical cooling system using stabilized phosphate, molybdate and zinc chloride.

In all cases, pitting and general corrosion rates were measured as per the same general method of Example 1 but without computer logging. The data for general and pitting corrosion rates are shown in FIG. 5 which is a graph of data accumulated over a 150-day period during which molybdate, the stabilized phosphate and, in addition, a water-soluble zinc compound were employed. As can be seen from FIG. 5, the pitting corrosion rate was always above the general corrosion rate. Indeed, and as is generally experienced by other workers, spiking of the pitting corrosion rate was noticeable and frequent throughout the test period.

A comparison of the results from Examples 4 and 5 (FIGS. 4 and 5) shows that when water-soluble zinc compounds are present, and for some unexplained reason, the pitting corrosion rate remains above the general corrosion rate. In this regard, it can be stated that the cooling system water of both Examples 4 and 5 was essentially comparable and that the corrosion inhibiting compositions were essentially the same, the primary difference being that the composition used in Example 5 contained zinc chloride sufficient to provide 2 ppm calculated as zinc.

It has thus been demonstrated that using the method and composition of the present invention, pitting corrosion rates equal to or less than general corrosion rates can be obtained using a combination of a water-soluble molybdate with a stabilized phosphate in the ranges discussed above and provided that active zinc is substantially excluded from the composition, i.e. zinc containing compounds or materials in which the zinc can act as an active corrosion inhibitor are kept below about 0.5 ppm. Generally speaking, water-soluble zinc compounds such as zinc halides, e.g. zinc chloride, are considered sources of active zinc.

The foregoing disclosure and description of the invention is illustrative and explanatory thereof, and various changes in the method and composition may be made within the scope of the appended claims without departing from the spirit of the invention.

What is claimed is:

1. A method of inhibiting the pitting corrosion rate of carbon steel in a cooling tower system comprising:

adding to a cooling tower liquid used in an open, recirculating cooling tower system an effective amount of a corrosion-inhibiting composition comprising from about 1 to about 10 ppm of a water-soluble molybdate, calculated as molybdate, and from about 5 to about 25 ppm of a stabilized orthophosphate, calculated as phosphate, said corrosion-inhibiting composition being substantially free of active zinc, said cooling tower liquid containing a calcium compound, the liquid of said cooling tower liquid consisting essentially of water, and circulating said cooling tower liquid in said system.

2. The method of claim 1 wherein said molybdate comprises an alkali metal molybdate.

3. The method of claim 1 wherein said molybdate is present in an amount of from about 3 to about 6 ppm.

4. The method of claim 1 wherein said stabilized phosphate is maintained in a range of from about 6 to about 12 ppm.

5. The method of claim 1 wherein said carbon steel contains existing tuberculation.

6. The method of claim 1 wherein the level of active zinc is 0.5 ppm or less.

7. A method of inhibiting the pitting corrosion rate of carbon steel in a cooling tower system comprising:

adding to a cooling tower liquid containing a calcium compound an effective amount of a corrosion-inhibiting composition consisting essentially of from about 1 to about 10 ppm of a water-soluble molybdate, calculated as molybdate, from about 5 to about 25 ppm of a stabilized orthophosphate, calculated as phosphate, and from about 1 to about 30 ppm of a phosphate stabilizer capable of preventing precipitation and/or crystallization of insoluble calcium phosphates under conditions that would result in precipitation of said phosphates in the absence of said phosphate stabilizer, said corrosion-inhibiting composition being substantially free of active zinc, and circulating said liquid in said system.

8. The method of claim 7 wherein said phosphate stabilizer comprises a low molecular weight, water-soluble polymer containing from about 10 to about 84 percent by weight of units derived from (meth)acrylic acids and salts, from greater than 11 to less than about 40 percent by weight of units derived from acrylamido alkyl or aryl sulfonates, and from at least about 5 to about 50 percent by weight of one or more units selected from vinyl esters, vinyl acetate and substituted acrylamide, and wherein said water-soluble polymer has a weight average molecular weight ranging from about 3,000 to about 25,000.

9. The method of claim 7 wherein said liquid of said cooling tower liquid consists essentially of water.

* * * * *